US006044512A

United States Patent [19]

Hornby et al.

[11] Patent Number: 6,044,512

[45] **Date of Patent: *Apr. 4, 2000**

[54] FOAM BUFFING PAD AND METHOD OF MANUFACTURE THEREOF

[75] Inventors: David M. Hornby, Sussex; Scott S. McLain, Wind Lake; Richard A. Kaiser, Hartland, all of Wis.

[73] Assignee: Lake Country Manufacturing, Inc., Hartland, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/858,749

[22] Filed: May 19, 1997

[51] Int. Cl.[7] ..... B05C 1/00; A47L 11/14

[52] U.S. Cl. ..... 15/97.1; 15/230; 15/230.18; 15/230.19; 15/244.1; 451/526

[58] Field of Search ..... 15/97.1, 97.2, 15/98, 230, 230.17, 230.18, 230.19, 244.1, 244.2, 244.3, 244.4; 451/495, 526, 528

[56] References Cited

U.S. PATENT DOCUMENTS

| | | | |
|---|---|---|---|
| D. 367,743 | 3/1996 | Krause et al. . | |
| 1,706,402 | 3/1929 | Hawn | 15/98 |
| 1,796,787 | 3/1931 | Hatfield | 15/230 |
| 2,556,003 | 6/1951 | Sandell | 15/244.1 |
| 2,581,567 | 1/1952 | Wiley . | |
| 2,803,027 | 8/1957 | Cooke . | |
| 2,934,775 | 5/1960 | Bergstrom | 15/230.19 |
| 3,114,924 | 12/1963 | Morrison . | |
| 3,418,675 | 12/1968 | Meguiar et al. . | |
| 4,617,767 | 10/1986 | Ali . | |
| 5,007,128 | 4/1991 | Englund | 15/244.4 |
| 5,058,233 | 10/1991 | Davis, III | 15/244.1 |
| 5,123,139 | 6/1992 | Leppert | 15/230.17 |
| 5,172,448 | 12/1992 | Kitahata . | |
| 5,389,032 | 2/1995 | Beardsley . | |
| 5,527,215 | 6/1996 | Rubino et al. . | |

FOREIGN PATENT DOCUMENTS

| | | | |
|---|---|---|---|
| 176157 | 6/1935 | Switzerland | 15/244.1 |
| 627346 | 8/1949 | United Kingdom | 15/244.4 |

*Primary Examiner*—Randall E. Chin
*Attorney, Agent, or Firm*—Andrus, Sceales, Starke & Sawall

[57] ABSTRACT

A rotary foam buffing pad is provided with a concave working face which allows the operator to provide true graduated surface contact in applying polish, buffing or glazing compounds, while containing the polishing compound against centrifugal force which would otherwise result in splattering of the compound. The manner in which the concave working face is formed and in which the edge face is formed and dressed results in dynamic balancing of the pad and reducing vibration and operator fatigue. The working surface forming and pad finishing operations further provide a velvetized texture to the pad working surfaces which further enhances the polishing or finishing process.

8 Claims, 4 Drawing Sheets

FOAM BUFFING PAD AND METHOD OF MANUFACTURE THEREOF

BACKGROUND OF THE INVENTION

The present invention pertains to foam pads for buffing and, more particularly, to rotary foam pads for buffing and polishing painted or similarly finished surfaces.

Foam buffing pads are now used in many buffing and polishing operations where synthetic or natural fiber pads, such as tufted wool pads, had previously been used. In particular, open cell polyurethane foam pads, with both reticulated and non-reticulated cell structures, have become particularly popular. However, despite the actual advantages of polymer foam pads over fibrous and tufted pads, there are still a number of inherent disadvantages attendant the use of foam pads. These disadvantages include "chatter" or jumping of the pad by excess frictional surface contact between flat working surface portions of the pad and the surface of the work being finished; splattering of the polish or other finishing compound as a result of the compound being thrown radially outwardly by centrifugal force; and, burning of the surface of the work being finished by the high speed outer edge portions of the rotary pad.

Attempts have been made to minimize or eliminate these problems by varying the type and density of foam used and by changing the working surface of the pads. Initially, foam pads were made of a generally cylindrical disc with a flat planar working face and, typically, with a radiused outer edge providing the transition between the working face and the outer cylindrical edge face. However, flat pads are particularly subject to chatter and provide little deterrent to the splatter of polish. Flat faced pads also give the operator little control over variations in the working surface actually in contact with the work surface being finished or polished. One attempt at solving the problems presented by flat foam buffing pads was the introduction of buffing pads having working surfaces with a convoluted or waffle shape. One such pad was previously made by Lake Country Manufacturing, Inc. Although this pad provided variable working surface contact by varying operator-applied pressure, surface contact was somewhat difficult to control and the pad did little to prevent splatter. A different approach to solving the prior art problems is shown in U.S. Pat. No. 5,527,215 where a cylindrical foam pad has a recessed center portion or portions within which the polishing compound may be trapped against radial splatter. This pad also provides the ability to alter the working surface contact by varying operator-applied pressure. However, neither of the foregoing pads adequately solves all of the prior art problems and, in addition, neither provides an operator with the ability to create true graduated surface contact which is uniform and predictable. Finally, rotary buffing pads are often inherently unbalanced because of the manner in which the pads are finished or mounted, resulting in undesirable vibrations, added chatter, and operator fatigue.

SUMMARY OF THE INVENTION

In accordance with the present invention, a rotary foam buffing pad and the manner in which it is manufactured provide a unique solution to all of the foregoing problems with prior art foam buffing pads. The result is a pad with superior performance in the elimination of chatter, prevention of polish splatter, and operator control of the working surface contact area.

In its preferred embodiment, the rotary compressible foam buffing pad of the present invention has a working face comprising a concave central contact surface and a peripheral outer contact surface. The outer contact surface provides an area of continuous working contact and encloses the central contact surface, precluding any substantial working contact by the central contact surface when the pad is generally uncompressed, but providing increased radial inward expansion of the area of working contact with increasing pad compression. The concave central contact surface extends radially inwardly from the outer contact surface to a central area of maximum concavity. The buffing pad includes a mounting face opposite the contact surface and an annular edge face which extends between and joins the mounting face and the outer contact surface.

The outer peripheral first contact surface preferably comprises a planar annular band. The inner concave contact surface may be conical or spherical. The pad may include a central opening which extends through the pad body on its rotational axis. Further, the annular edge face of the pad which joins the working face and the mounting face may be generally cylindrical or frustoconical and, in the latter case, having a maximum diameter where it joins the working face. The mounting face of the pad adapts the same for attachment to a backing plate, either with a permanent connection or with a demountable fastener, such as a hook and loop type fastening system.

In accordance with a preferred method for making a rotary foam buffing pad of the present invention, a generally cylindrical preform of foam material is utilized, which preform has generally flat parallel front and rear faces which are interconnected by a cylindrical edge face, the method comprising the steps of: rotating the preform on its axis, and dynamically forming a concave working face on the front face during rotation. The method may also include the step of dynamically forming a conical surface on the edge face during rotation. The preform is preferably rotated by supporting the same by its rear face on the backing plate, and grinding the front face of the pad while it is being rotated to move material from the face to provide the concave working face. The grinding step preferably includes texturizing the working face to enhance buffing performance. The edge face may also be ground and texturized in a similar manner.

DETAILED DESCRIPTION OF THE PREFERRED EMBODIMENTS

Figure 1:
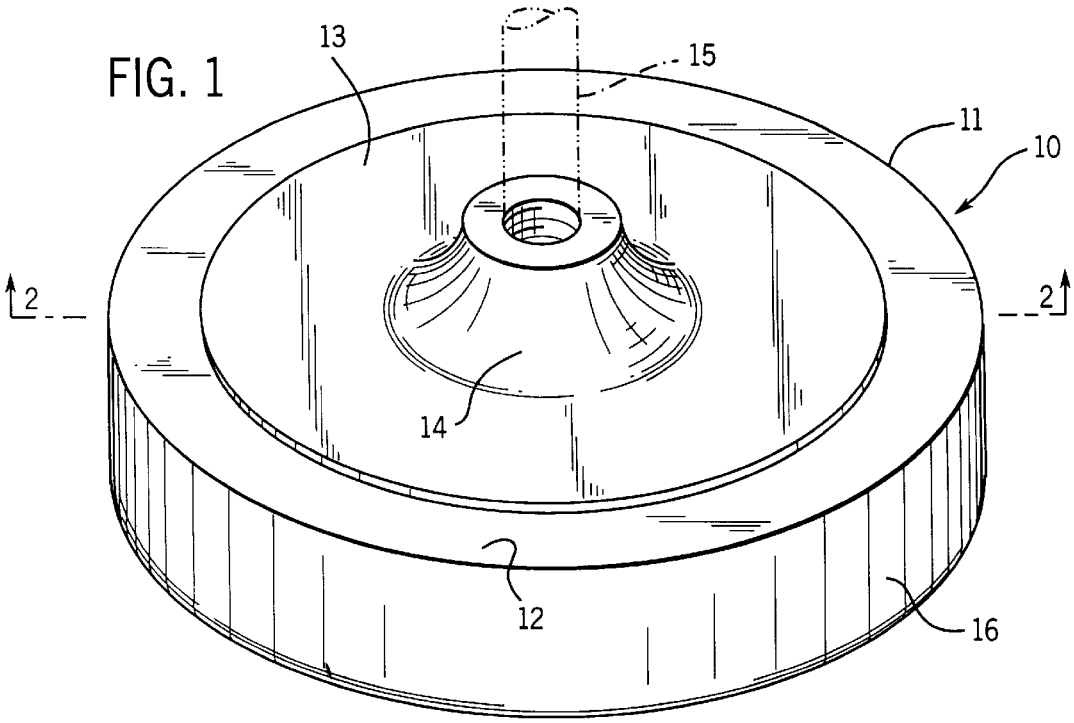
FIG. 1 is a perspective view of one embodiment of a foam buffing pad of the present invention.

As shown in FIG. 1, a rotary foam buffing pad 10 of one embodiment includes a generally cylindrical body 11 having a flat planar mounting face 12 by which it is attached to a backing plate 13. The backing-plate 13 includes a central hub 14 having a tapped bore or other means for mounting the pad on the driven shaft 15 of a powered rotary buffing machine, all in a manner well known in the art.

The cylindrical buffing pad body 11 is, also in a manner well known in the art, cut from a sheet of foam material using a knife or hot wire apparatus to form the conventional cylindrical shape. The working face of such prior art pads, on the side of the body opposite the mounting face 12 and not shown in FIG. 1 is also flat. Buffing pads of this type have been widely used, but are subject to the inherent problems of splattering and pad chatter described above.

Pads made of open pore polyurethane foam, with either reticulated or non-reticulated structure, have found particular favor in the prior art. The surfaces of such pads, including both the rear mounting face and front working face, as well as the knife or hot wire cut side face 16, all initially exhibit a smooth texture. Such a smooth texture, particularly on the flat working face of prior art pads, contributes to initial pad chatter and jumping because of enhanced friction between the smooth textured pad surface and the surface being buffed or polished.

Figure 2:
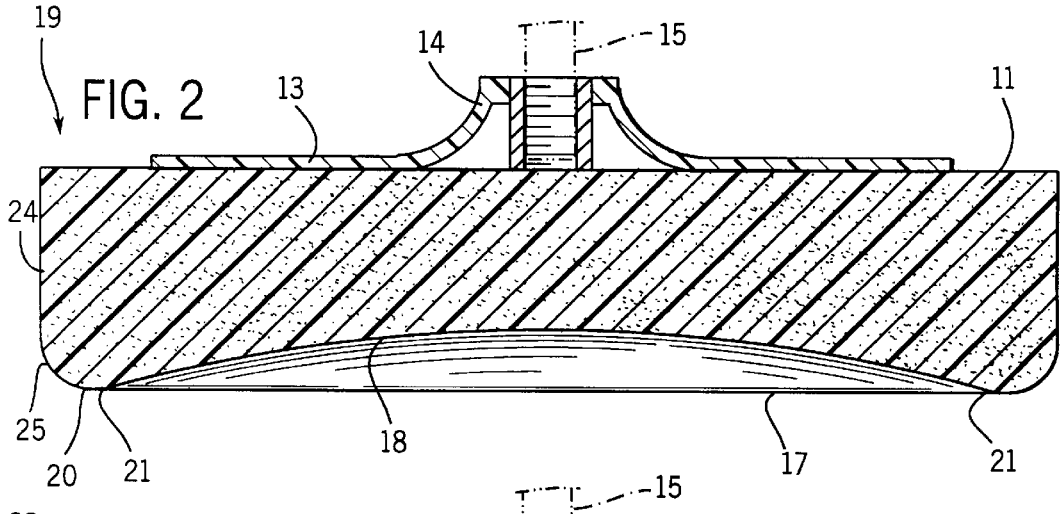
FIG. 2 is a vertical section through the pad taken on line 2—2 of FIG. 1.
Figure 3:
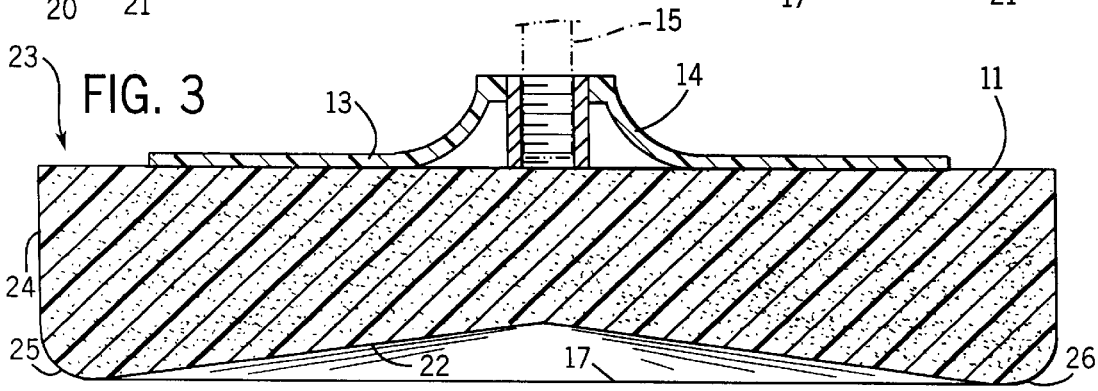
FIG. 3 is a vertical section similar to FIG. 2 showing an alternate embodiment of the concave working surface.
Figure 4:
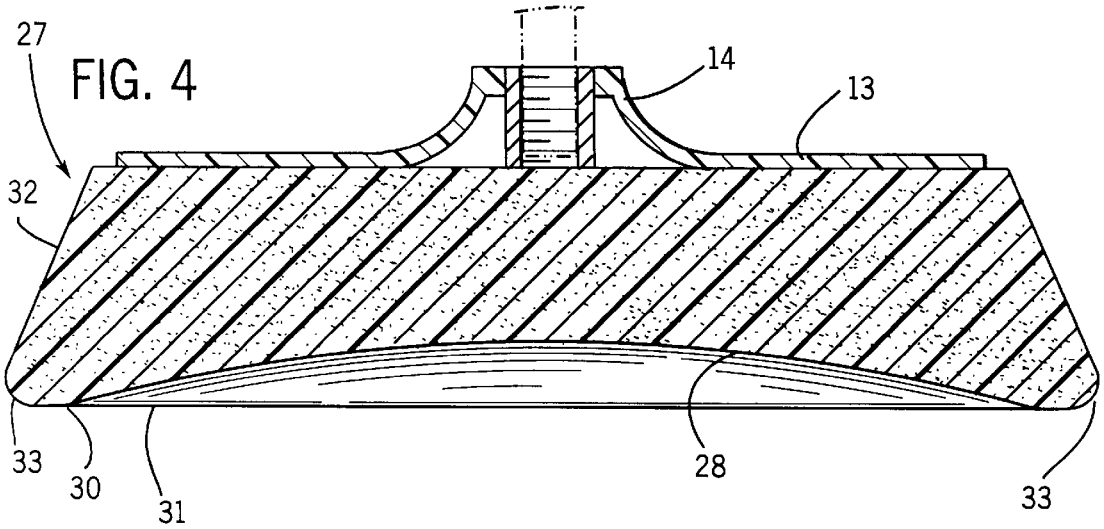
FIG. 4 is a vertical section similar to FIG. 2 showing another embodiment of the invention.

Referring also to FIGS. 2–4, there are shown vertical sectional views of three embodiments of a rotary foam buffing pad in which the working face 17 is finished in accordance with the present invention. In all three embodiments, the working face 17 includes a concave central portion which provides improved performance both in the reduction of chatter and in preventing the splattering of polish, glazes and other finishing pounds applied by the buffing pad. In addition, the manner in which the concave working face 17 is formed provides a texturized surface which also helps to reduce initial pad chatter. Further, the method of forming the concave working face provides a dynamic balance to the pad previously unattainable in prior art foam buffing pads. In the FIG. 2 embodiment, the working face 17 of the pad 19 is provided with a spherical concave recess 18 having a maximum depth or maximum concavity in the center on the axis of pad rotation. It is believed that the concave recess 18 should have a maximum depth of at least ¼" (about 6 mm) and should not exceed about ¾" (about 19 mm). Ideally, the recess should be about ½" (about 13 mm) deep. The concave recess 18 tapers radially outwardly to an outer peripheral contact surface 20 which, in this embodiment, comprises a very narrow planar annular band 21.

In FIG. 3, the working face 17 of the pad 23 is provided with a conical concave recess 22. The pad 23 is otherwise identical to the pad 19 of the FIG. 2 embodiment. Thus, both pads 19 and 23 are of generally cylindrical shape and include a cylindrical edge face 24 and a radiused transition 25 between the edge face 24 and the respective planar annular bands 21 and 26 of the two pad embodiments.

In the FIG. 4 embodiment, the foam buffing pad 27 includes a spherical concave recess 28 in the working face 17 which is similar to the concave recess 18 of the FIG. 2 embodiment. In the FIG. 4 pad 27, however, the outer peripheral contact surface 30 comprises a planar annular band 31 which is somewhat wider than the band 21 of the FIG. 2 embodiment. The pad 27 also includes a tapered edge face 32 resulting in a somewhat sharper radiused transition 33 between the edge face 32 and the contact surface 30 of the working face.

By a selective application of varying amounts of pressure by the operator in use, each of the pads 19, 23 and 27 of the embodiments of FIGS. 2–4 can provide controlled graduated working contact surface in a manner which will be described in detail with respect to the pad in FIGS. 5, 5A and 5B. The buffing pad 34 in FIG. 5 includes a backing plate and mounting system which is different from the embodiments of FIGS. 2–4. The pad 34 is demountably attached to a cushioned backing plate 35 with a hook and loop fastener 36 of a type well known in the industry. The cushioned backing plate includes a rigid backing plate 37 (similar to the backing plate 13 previously described) to which an intermediate cushion pad 38 is attached, the opposite face of which includes half of the hook and loop fastener 36 to which the pad 34 is attached by its mounting face 40. The pad 34 and the cushion pad 38 are provided with through bores 41 to receive a nut (not shown) for attachment to a threaded driven shaft 42 of a buffing machine. The through bores 41 may also be utilized to align the pad with the cushioned backing plate 35 for pad attachment or reattachment.

Figure 5:
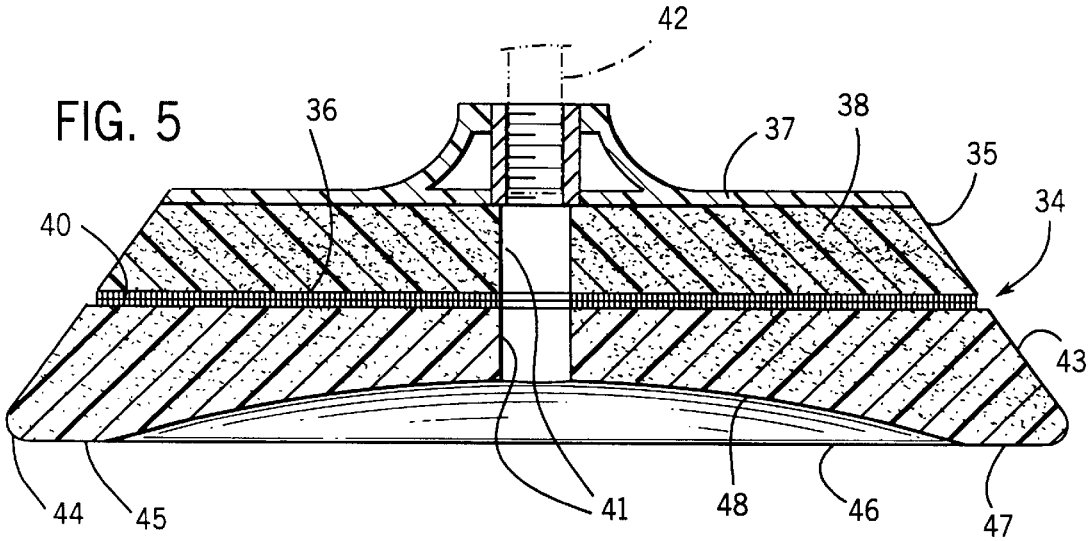
FIGS. 5, 5A and 5B are vertical sections, similar to FIGS. 2–4, showing another embodiment of the invention in various stages of graduated surface contact.
Figure 5A:
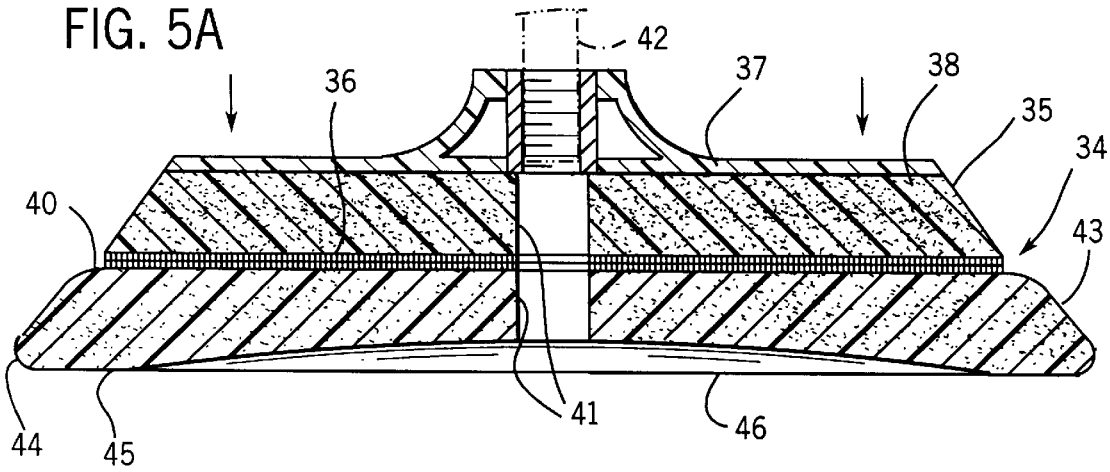
Figure 5B:
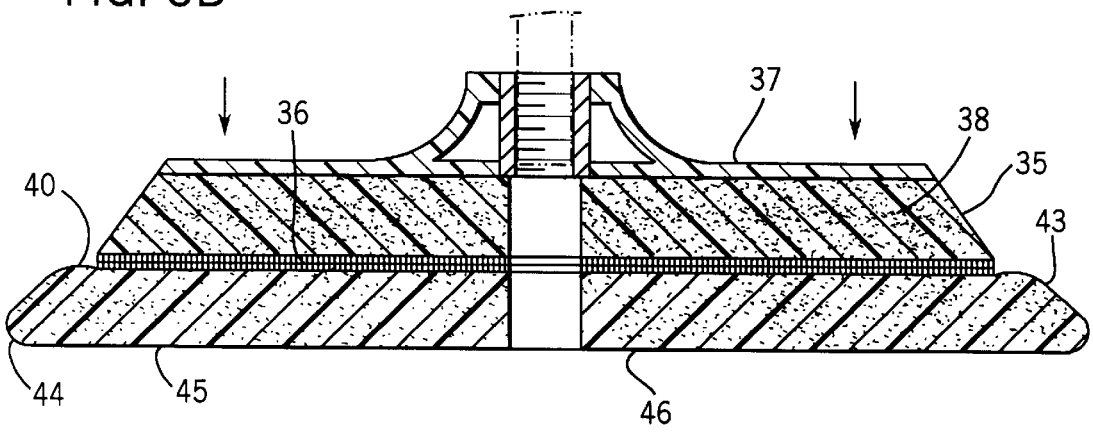

The pad 34 of the FIG. 5 embodiment includes a tapered edge face 43 and a radiused peripheral edge 44 which provides the transition to a peripheral contact surface 45 on the working face 46 of the pad. The peripheral contact surface 45 comprises a planar annular band 47, similar to the previously described embodiments, but somewhat larger in radial width. The radial inner edge of the planar annular band 47 joins the outer edge of a spherical concave recess 48 generally similar to the recesses 18 and 28 of the FIG. 2 and FIG. 4 embodiments, respectively. The spherical concave recess 48 is, of course, interrupted centrally by the through bore 41.

The FIG. 5 pad 34 provides the same improvements over prior art pads as do the pads shown in FIGS. 2–4 and previously described. The concave recess 48, when the pad is in the substantially uncompressed state shown in FIG. 5, may contain the polish, buffing or glazing compound being used to finish a surface. The concave recess is completely enclosed by the planar annular band 47 which provides full contact with the surface being finished. This enclosure of the polish or finishing compound prevents splattering when the pad is rotated and centrifugal force throws the paste material radially outwardly. In addition, initial startup of the pad in the FIG. 5 position minimizes pad chatter because of the minimal contact by the working face 46, namely, only the planar annular band 47. However, as the operator provides added pressure to the pad 34, by forcing the shaft mounted backing plate 37 downwardly, the spherical concave recess 48 begins to flatten and the working face 46 expands in a radially inward direction, as shown in FIG. 5A. As operator pressure is increased and the pad compresses further, the entire concave recess 48 will eventually be flattened and there will result full working face contact with the workpiece being finished, as shown in FIG. 5B. This graduated working face contact provides the operator with far greater control over the active working surface than do pads of the prior art including flat-faced pads, waffle-faced pads, or stepped or slotted recess pads.

The particular embodiment of the FIG. 5 pad, and to a lesser extent the pad 27 of FIG. 4, provide additional benefits in terms of working face control and enhanced utility to the operator because of the tapered frustoconical edge faces. The tapered edge face 43 in the FIG. 5 embodiment permits the working face to flatten more readily under increasing operator pressure than does the tapered edge face 32 of FIG. 4, and even more so with respect to the cylindrical edge faces 24 of the embodiments of FIGS. 2 and 3. This increased flexibility is also important in helping to prevent burning of the workpiece surface being finished, particularly since the outer peripheral contact surface portion 45 of the pad is moving at the greatest actual velocity. The cushion pad 38 forming a part of the backing plate 35 is also typically made of a foam material, but a material which is substantially more dense than the foam used in the pad 34. Typically, the cushion pad 38 will not undergo significant compression until the foam buffing pad 34 has been virtually fully compressed to the condition shown in FIG. 5B.

Figure 6:
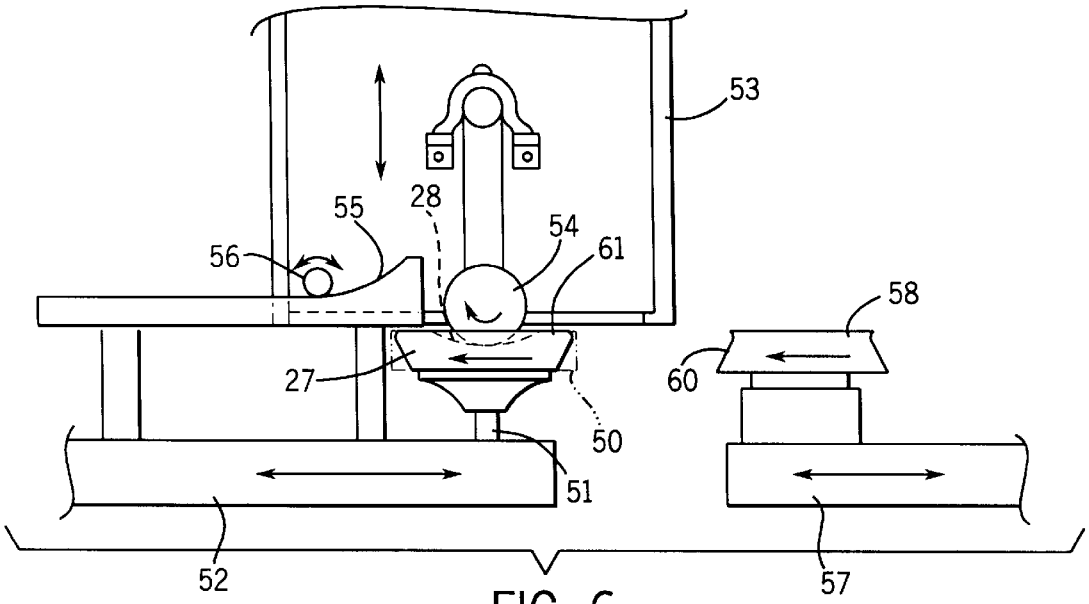
FIG. 6 is a front elevation of a schematic depiction of an apparatus for forming the working surface of pads of the present invention.
Figure 7:
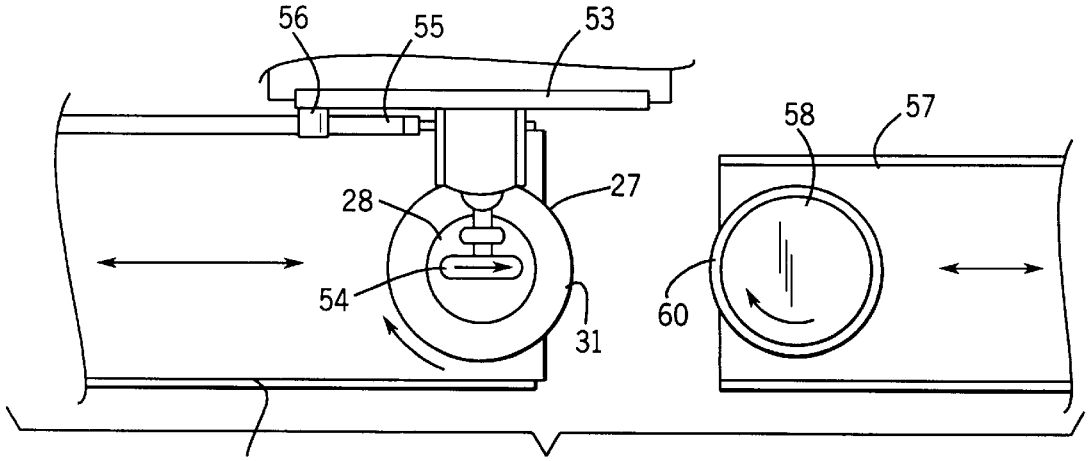
FIG. 7 is a schematic top plan view of the apparatus shown in FIG. 6.

Referring now to FIGS. 6 and 7, the presently preferred apparatus and method for making foam buffing pads of the present invention will now be described. It should be understood, however, that buffing pads with concave recessed working faces of the type described in the various preceding embodiments may be formed by other methods and using other apparatus. As will be described, the present method and apparatus, in addition to providing inherent efficiencies in the manufacture, also results in certain improved pad features.

A cylindrical flat-faced pad body 50 (which may be identical to the pad body 11 shown in FIG. 1) is attached to a backing plate (either of the permanent type backing plate 13 or the demountable type backing plate 35). The pad body 50 and backing plate are attached to a driven rotary spindle 51 which is mounted on a horizontally reciprocable slide carriage 52. The slide carriage 52 operates generally beneath a vertically reciprocable first tool slide 53 which carries a driven first grinding wheel 54. The upper portion of the slide carriage 52 includes a cam surface 55 which cooperates with a cam follower 56 carried on the first tool slide 53. A second tool slide 57 is mounted for horizontal reciprocating movement toward and away from the slide carriage 52. The second tool slide carries a second grinding wheel 58 which is also rotatably driven, preferably in the same direction as the rotary spindle 51 on which the pad body 50 is mounted.

Although the sequence of operation may be reversed, the first tool slide 53 is moved vertically upwardly away from the slide carriage 52 to an inoperative upper position, as with an air cylinder actuator (not shown) or similar positioning device. With the pad body 50 rotating on the driven spindle 51, the second tool slide 57 is moved horizontally toward the slide carriage 52. The second grinding wheel 58 includes a profiled peripheral face 60. Using the buffing pad 27 of the FIG. 4 embodiment as an example, the profile of the second grinding wheel 58 is shaped to form the tapered edge face 32 and radiused transition 33 simultaneously as the rotating grinding wheel 58 is brought into contact with the rotating pad body 50. The second tool slide 57 is then withdrawn horizontally and the first tool slide 53 is moved vertically downward from its inoperative upper position to bring the first grinding wheel 54 into contact with the unfinished flat working face 61 of the pad body 50. The first grinding wheel 54 is moved against the flat working face 61 of the rotating pad body 50 and moved further downwardly to the desired depth of the spherical concave recess 28 at which time the slide carriage 52 is moved horizontally (to the left as viewed in FIGS. 6 and 7) with engagement of the cam surface 55 with the cam follower 56 causing the first tool slide 53 to move vertically upwardly, overcoming the bias of the air cylinder or other slide positioning device, causing the peripheral surface of the first grinding wheel 54 to move in a shallow circular arc relative to the pad body and to form the spherical concave recess 28.

The result of the dynamic pad side edge and working face formation described above is a perfectly rotationally balanced buffing pad not previously attained in the prior art. Where the buffing pad 27 of the FIG. 4 type is formed with a permanently affixed backing plate 13, the pad is effectively balanced for its full useful life. If a demountable buffing pad, attained and can be retained in subsequent demounting and reattachment (via the hook and loop fastener 36) by utilizing the through bores 41 as pilot holes.

An alternate method of forming a concave recess on the working face of a foam buffing pad utilizes permanent deformation of a pad body with an initial flat face, rather than cutting or grinding the material from the face. In such a method, a concave heated platen is used to apply a layer of melted plastic, such as polyethylene to the rear mounting face of the pad and, as the pad is pressed into the platen, the opposite front working face is drawn into a concave shape. After the polyethylene layer has been cooled and set, the concave shape of the front working face is retained. The polyethylene bonding layer may also be utilized to attach one-half of a hook and loop fastener material to the working face of the pad as well.

In addition, by utilizing abrasive grinding tools on both the first and second grinding wheels 54 and 58, the typically smooth surface of virgin open cell polyurethane foam stock is roughened in the forming process. This roughened or texturized surface provides a velvetizing effect which has the beneficial effect of providing a softened buffing surface and reducing initial pad chatter because of reduced friction.

We claim:

1. A rotary buffing device for applying a finishing compound to and removing blemishes from a painted surface comprising:

an open cell polyurethane foam pad including a compressible body having a center axis of rotation, a circular working face and an outer opposite flat mounting face;

a single continuous outer peripheral first contact surface of the pad on a portion of the working face, said first contact surface defining a planar annular band of continuous working contact, said band having an inner radial edge and enclosing a remaining portion of the working face when the pad body is generally uncompressed; and an inner second contact surface on said remaining portion of the working face extending from a radial outer edge defined by the inner radial edge and in the plane of said planar annular band radially inwardly toward the axis of rotation of the pad, said second contact surface having a continuous and gradually tapering concave shape with a maximum depth in the range of at least ¼ inch to about ¾ inch, said second contact surface providing continuous and uniformly increasing working contact radially inwardly from said first contact surface in response to increasing working load applied in the direction of the axis of rotation and resulting compression of said pad, said second contact surface acting to permit radial outward dispersion of the finishing compound by centrifugal force over said second contact surface toward said first contact surface and to prevent radially outward splatter of the compound beyond said outer peripheral first contact surface.

2. The buffing pad as set forth in claim 1 wherein said second contact surface is conical.

3. The buffing pad as set forth in claim 1 wherein said second contact surface is spherical.

4. The buffing pad as set forth in claim 1 including a central opening extending through said pad body on the axis of rotation.

5. The buffing pad as set forth in claim 1 wherein said body includes an annular edge face extending between and joining the working face and the mounting face.

6. The buffing pad as set forth in claim 5 wherein said edge face is frustoconical and has a maximum diameter where it joins the working face.

7. The buffing pad as set forth in claim 1 including a backing plate attached to the mounting face of the pad body.

8. The buffing pad as set forth in claim 7 wherein the backing plate is demountable.

* * * * *